US011398347B2

(12) United States Patent
Cheng et al.

(10) Patent No.: US 11,398,347 B2
(45) Date of Patent: Jul. 26, 2022

(54) INDUCTOR WITH FERROMAGNETIC CORES

(71) Applicant: INTERNATIONAL BUSINESS MACHINES CORPORATION, Armonk, NY (US)

(72) Inventors: Kangguo Cheng, Schenectady, NY (US); Juntao Li, Cohoes, NY (US); Geng Wang, Stormville, NY (US); Qintao Zhang, Mt. Kisco, NY (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 996 days.

(21) Appl. No.: 16/121,013

(22) Filed: Sep. 4, 2018

(65) Prior Publication Data

US 2019/0019617 A1 Jan. 17, 2019

Related U.S. Application Data

(62) Division of application No. 15/455,569, filed on Mar. 10, 2017, now Pat. No. 10,553,354.

(51) Int. Cl.
*H01F 41/04* (2006.01)
*H01F 27/28* (2006.01)
(Continued)

(52) U.S. Cl.
CPC ..... *H01F 41/046* (2013.01); *H01F 27/24* (2013.01); *H01F 27/2804* (2013.01);
(Continued)

(58) Field of Classification Search
CPC ..... H01F 27/24; H01F 27/28; H01F 27/2804; H01F 27/2809; H01F 27/32;
(Continued)

(56) References Cited

U.S. PATENT DOCUMENTS 5,576,680 A 11/1996 Ling
6,166,422 A 12/2000 Qian et al.
(Continued)

FOREIGN PATENT DOCUMENTS

CN 114203668 * 3/2022 ..... H01L 23/5227
CN 216435933 * 5/2022 ..... H01L 49/02
(Continued)

OTHER PUBLICATIONS

Gardner et al., "Integrated On-Chip Inductors with Magnetic Films," IEEE Transactions on Magnetics, Jun. 2007, pp. 2615-2617.
(Continued)

*Primary Examiner* — Matthew V Nguyen
(74) *Attorney, Agent, or Firm* — Cantor Colburn LLP; Randall Bluestone

(57) ABSTRACT

An inductor device includes a substrate, and a plurality of first trenches including a first metal on the substrate to form first metal layers. The first metal layers are arranged substantially parallel to the substrate. A plurality of second trenches including a second metal is over the first metal layers and includes first portions and second portions. The first portions are substantially parallel to and interdigitate the first metal layers. The second portions are substantially perpendicular to the first portions, extend from ends of the first portions, and are oriented in opposite directions such that the second portions extend over ends of adjacent first metal layers. A plurality of vias connects the first metal layers to the second metal layers. A plurality of magnetic trenches is over the first metal layers, under the second metal layers, and substantially parallel to the second portions of the plurality of second trenches.

20 Claims, 7 Drawing Sheets

(51) Int. Cl.
*H01F 27/24* (2006.01)
*H01F 41/14* (2006.01)
*H01F 27/32* (2006.01)

(52) U.S. Cl.
CPC ..... *H01F 27/324* (2013.01); *H01F 41/041* (2013.01); *H01F 41/14* (2013.01); *Y10T 29/4902* (2015.01); *Y10T 29/49073* (2015.01); *Y10T 29/49075* (2015.01)

(58) Field of Classification Search
CPC .... H01F 27/324; H01F 41/041; H01F 41/046; H01F 41/14; Y10T 29/4902; Y10T 29/49073; Y10T 29/49075
See application file for complete search history.

(56) References Cited

U.S. PATENT DOCUMENTS

| | | | | |
|---|---|---|---|---|
| 6,573,148 | B1 | 6/2003 | Bothra | |
| 6,612,019 | B2 | 9/2003 | Ahn et al. | |
| 6,650,529 | B1 | 11/2003 | Murata et al. | |
| 6,667,536 | B2 * | 12/2003 | Chaudhry | H01L 28/10 257/E21.022 |
| 6,927,666 | B2 | 8/2005 | Ahn et al. | |
| 7,005,955 | B2 | 2/2006 | Schumacher et al. | |
| 7,875,953 | B2 | 1/2011 | Xie | |
| 8,154,083 | B2 | 4/2012 | Park | |
| 8,314,676 | B1 | 11/2012 | Smeys et al. | |
| 8,385,047 | B2 | 2/2013 | Xie et al. | |
| 9,219,109 | B2 | 12/2015 | Tseng et al. | |
| 2003/0080845 | A1 | 5/2003 | Fontanella et al. | |
| 2005/0174209 | A1 | 8/2005 | Teshima et al. | |
| 2007/0155152 | A1 | 7/2007 | Kang | |
| 2007/0222549 | A1 | 9/2007 | Lim et al. | |
| 2009/0322461 | A1 | 12/2009 | Hebert et al. | |
| 2011/0133881 | A1 | 6/2011 | Nakajima et al. | |
| 2013/0093032 | A1 * | 4/2013 | Webb | H01L 23/645 257/E29.323 |
| 2014/0062646 | A1 | 3/2014 | Morrissey et al. | |
| 2014/0216939 | A1 | 8/2014 | Fontana, Jr. et al. | |
| 2015/0171157 | A1 | 6/2015 | Sturcken et al. | |
| 2016/0035816 | A1 * | 2/2016 | Hong | H01F 41/14 438/381 |
| 2016/0268195 | A1 | 9/2016 | Lee et al. | |
| 2017/0053668 | A1 | 2/2017 | Hixson-Goldsmith et al. | |
| 2018/0374629 | A1 | 12/2018 | Cheng et al. | |

FOREIGN PATENT DOCUMENTS

| | | | |
|---|---|---|---|
| JP | 2008027982 | A | 2/2008 |
| JP | 2019068047 | A | 4/2019 |

OTHER PUBLICATIONS

Kim et al., "Highly Laminated Soft Magnetic Electroplated CoNiFe Thick Films," IEEE Magnetics Letters, Soft magnetic Materials, Published Nov. 5, 2013, pp. 1-4.
Kim et al., "Microfabrication of toroidal inductors integrated with nanolaminated ferromagnetic metallic cores," Journal of Micromechanics and Microengineering, 2013, Published Oct. 25, 2013, pp. 1-9.
Lee et al., "Embedded Integrated Inductors With a Single Layer Magnetic Core: a Realistic Option," Department of Materials Science and Engineering, Stanford University, 2003, pp. 1-37.
Mathuna et al. "Review of integrated magnetics for power supply on chip (PwrSoC)," IEEE Transactions on Power Electronics, Nov. 2012, pp. 4799-4816.
Park et al., "Ultralow-profile micromachined power inductors with highly laminated Ni/Fe cores: application to low-megahertz DC-DC converters," IEEE Transactions on Magnetics, vol. 39, No. 5, Sep. 2003, pp. 3184-3186.
Wu et al., "Improved high frequency response and quality factor of on-chip ferromagnetic thin film inductors by aminating and patterning Co—Zr—Ta—B films," IEEE Transactions on Magnetics, 2013, pp. 4176-4179.
Yu et al., "Silicon-embedded 3D toroidal air-core inductor with through-wafer interconnect for on-chip integration," Micro Electro Mechanical Systems (MEMS), 2012 IEEE 25th International Conference, (2012) pp. 1-4.
Kangguo Cheng, et al., "Inductor With Ferromagnetic Cores", U.S. Appl. No. 15/455,569, filed Mar. 10, 2017.
Kangguo Cheng, et al., "Inductor With Ferromagnetic Cores", U.S. Appl. No. 16/120,992, filed Sep. 4, 2018.
List of IBM Patents or Patent Applications Treated as Related; (Appendix P), Filed Sep. 6, 2018; 2 pages.

* cited by examiner

INDUCTOR WITH FERROMAGNETIC CORES

DOMESTIC PRIORITY

This application is a division of and claims priority from U.S. patent application Ser. No. 15/455,569, filed on Mar. 10, 2017, the entire contents of which are incorporated herein by reference.

BACKGROUND

Embodiments of the present invention relate in general to complementary metal oxide semiconductor (CMOS) technology, and more specifically, inductors in CMOS devices.

CMOS technology is used to construct integrated circuits such as microprocessors, microcontrollers, static random access memory (RAM) and other digital logic circuits. A basic component of CMOS designs is metal oxide semiconductor field effect transistors (MOSFETs).

An inductor is a passive two-terminal electrical device that stores electrical energy in a magnetic field when electric current is flowing through it. An inductor can include an electric conductor, such as a wire, that is wound into a coil. When the current flowing through an inductor changes, the time-varying magnetic field induces a voltage in the electric conductor. The direction of induced electromotive force (e.m.f) opposes the change in current that created it, and, as a result, inductors oppose any changes in current through them. The inductance of an inductor device is the ratio of the voltage to the rate of change of current.

Along with capacitors and resistors, inductors are one of the three passive linear circuit elements that make up electronic circuits. Inductors are used in alternating current (AC) electronic equipment, such as in radio equipment. Generally, inductors are made during back-end-of-line (BEOL) processing.

SUMMARY

According to one or more embodiments of the invention, a method of making an inductor device includes forming a first metal layer on a substrate, and depositing an interlevel dielectric (ILD) on the first metal layer. A trench is patterned in the ILD, and a magnetic material is deposited in the trench. The trench in the ILD is arranged substantially perpendicular to the first metal layer. Another layer of ILD is deposited on the trench filled with the magnetic material, and a via is patterned adjacent to the trench filled with magnetic material, with the via extending from the first metal layer to a top surface of the layer of ILD. Trenches are patterned in the layer of ILD. The trenches include two portions, a first portion and a second portion. The first portion is arranged over, adjacent to and substantially parallel the first metal layer. The second portion arranged substantially perpendicular to the first portion and extends from an end of the first portion to the via, such that the first metal layer and the trenches are connected to one another through the via. A metal is deposited in the via, and a metal is deposited in the trenches in the layer of ILD to form a second metal layer, the second metal layer connected to the first metal layer through the via.

According to other embodiments, s method of making an inductor device includes forming a plurality of first metal layers on a substrate, and depositing an interlevel dielectric (ILD) on the plurality of first metal layers. A plurality of trenches is patterned in the ILD, and a magnetic material is deposited in the plurality of trenches. The plurality of trenches in the ILD are arranged substantially perpendicular to the plurality of first metal layers. Another layer of ILD is deposited on the plurality of trenches filled with the magnetic material, and a plurality of vias is patterned adjacent to the trenches filled with the magnetic material. The plurality of vias extend from the plurality of first metal layers to a top surface of the another layer of ILD. Trenches are patterned in the layer of ILD. The trenches include two portions, first portions and second portions. The first portions are arranged over and adjacent to and substantially parallel the plurality of first metal layers, and the second portions are arranged substantially perpendicular to the first portions, extend from both ends of the first portions, and are oriented in opposite directions such that the second portions are continuous with the plurality of vias. A metal is deposited in the plurality of vias and the trenches in the another layer of ILD to form a plurality of second metal layers, wherein the plurality of second metal layers is connected to the plurality of first metal layers through the via.

Yet, according to other embodiments, an inductor device includes a substrate, and a plurality of first trenches including a first metal arranged on the substrate. The plurality of first trenches form first metal layers, with the first metal layers being arranged substantially parallel to the substrate. The device further includes a plurality of second trenches including a second metal arranged over the first metal layers. The plurality of second trenches includes two portions, first portions and second portions. The first portions are arranged substantially parallel to and interdigitate the first metal layers. The second portions are arranged substantially perpendicular to the first portions, extend from both ends of the first portions, and are oriented in opposite directions such that the second portions extend over ends of adjacent first metal layers. A plurality of vias connects the first metal layers to the second metal layers, and a plurality of magnetic trenches is arranged on the substrate. The plurality of magnetic trenches is arranged over the first metal layers, under the second metal layers, and substantially parallel to the second portions of the plurality of second trenches.

BRIEF DESCRIPTION OF THE DRAWINGS

The subject matter which is regarded as embodiments of the invention is particularly pointed out and distinctly claimed in the claims at the conclusion of the specification. The foregoing and other advantages of the embodiments of the invention are apparent from the following detailed description taken in conjunction with the accompanying drawings in which:

FIGS. 1-6B illustrate exemplary methods of making inductor devices according to one or more embodiments, in which:

FIG. 1 is a cross-sectional side view of an insulating layer arranged on a substrate;

FIG. 6B is a cross-sectional side view through the B-B' axis of FIG. 6A;

DETAILED DESCRIPTION

Figure 1:
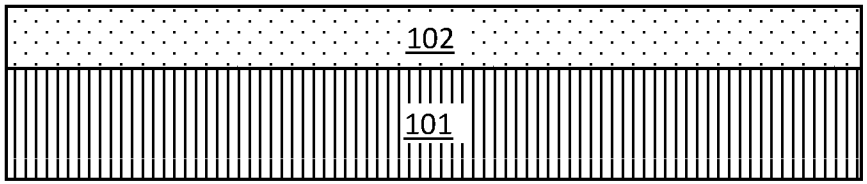

Embodiments of the present invention are described herein with reference to the related drawings. Alternative embodiments can be devised without departing from the scope of this invention. It is noted that various connections and positional relationships (e.g., over, below, adjacent, etc.) are set forth between elements in the following description and in the drawings. These connections and/or positional relationships, unless specified otherwise, can be direct or indirect, and the present invention is not intended to be limiting in this respect. Accordingly, a coupling of entities can refer to either a direct or an indirect coupling, and a positional relationship between entities can be a direct or indirect positional relationship. As an example of an indirect positional relationship, references in the present description to forming layer "A" over layer "B" include situations in which one or more intermediate layers (e.g., layer "C") is between layer "A" and layer "B" as long as the relevant characteristics and functionalities of layer "A" and layer "B" are not substantially changed by the intermediate layer(s).

The following definitions and abbreviations are to be used for the interpretation of the claims and the specification. As used herein, the terms "comprises," "comprising," "includes," "including," "has," "having," "contains" or "containing," or any other variation thereof, are intended to cover a non-exclusive inclusion. For example, a composition, a mixture, process, method, article, or apparatus that comprises a list of elements is not necessarily limited to only those elements but can include other elements not expressly listed or inherent to such composition, mixture, process, method, article, or apparatus.

Additionally, the term "exemplary" is used herein to mean "serving as an example, instance or illustration." Any embodiment or design described herein as "exemplary" is not necessarily to be construed as preferred or advantageous over other embodiments or designs. The terms "at least one" and "one or more" are understood to include any integer number greater than or equal to one, i.e. one, two, three, four, etc. The terms "a plurality" are understood to include any integer number greater than or equal to two, i.e. two, three, four, five, etc. The term "connection" can include an indirect "connection" and a direct "connection."

References in the specification to "one embodiment," "an embodiment," "an example embodiment," etc., indicate that the embodiment described can include a particular feature or characteristic, but every embodiment may or may not include the particular structure or characteristic. Moreover, such phrases are not necessarily referring to the same embodiment. Further, when a particular structure or characteristic is described in connection with an embodiment, it is submitted that it is within the knowledge of one skilled in the art to affect such structure or characteristic in connection with other embodiments whether or not explicitly described.

For purposes of the description hereinafter, the terms "upper," "lower," "right," "left," "vertical," "horizontal," "top," "bottom," and derivatives thereof shall relate to the described structures and methods, as oriented in the drawing figures. The terms "overlying," "atop," "on top," "positioned on" or "positioned atop" mean that a first element, such as a first structure, is present on a second element, such as a second structure, wherein intervening elements such as an interface structure can be present between the first element and the second element. The term "direct contact" means that a first element, such as a first structure, and a second element, such as a second structure, are connected without any intermediary conducting, insulating or semiconductor layers at the interface of the two elements. It should be noted that the term "selective to," such as, for example, "a first element selective to a second element," means that the first element can be etched and the second element can act as an etch stop.

As used herein, the terms "about," "substantially," "approximately," and variations thereof are intended to include the degree of error associated with measurement of the particular quantity based upon the equipment available at the time of filing the application. For example, "about" can include a range of ±8% or 5%, or 2% of a given value.

For the sake of brevity, conventional techniques related to semiconductor device and integrated circuit (IC) fabrication may or may not be described in detail herein. Moreover, the various tasks and process steps described herein can be incorporated into a more comprehensive procedure or process having additional steps or functionality not described in detail herein. In particular, various steps in the manufacture of semiconductor devices and semiconductor-based ICs are well known and so, in the interest of brevity, many conventional steps will only be mentioned briefly herein or will be omitted entirely without providing the well-known process details.

Turning now to a description of technologies that are more specifically relevant to aspects of the present invention, integration of an inductor component with CMOS devices on the same chip has become increasingly challenging as CMOS scales beyond 7 nanometers (nm). As mentioned above, inductors are generally made and integrated during BEOL processing, which means that the inductors are made in a different area than the active transistor area and subsequently connected to the active transistors with a metal connect, resulting in a large footprint. However, integrating them into the CMOS process flows can reduce the overall density of integration and increase the cost of the manufacturing. Furthermore, inductor designs and fabrications generally include a single magnetic core, which can result in high eddy currents, and therefore, energy loss. In view of the foregoing challenges, there is a need for process flows and devices that integrate inductors with laminated magnetic cores to improve device performance, as well as reduce energy loss during operation.

Accordingly, various embodiments described herein are methods and structures for forming inductor devices with laminated magnetic cores (magnetic cores surrounded by dielectric) that use CMOS process flows. High density and high aspect ratio magnetic trenches, for example, cobalt trenches, are laminated within an ILD. The metal trenches are surrounded by first and second metal layers, arranged above and below the metal trenches. The first and second metal layers are connected by vias to form a spiral structure around the metal trenches (see FIGS. 5A-7B). The resulting structures reduce energy loss, due to the ability to pattern metal trenches at high densities within dielectric laminations. The laminated metal trenches also reduce energy loss due to Eddy current generation. The greater the number of laminations per unit area, perpendicular to the applied field, the greater the suppression of Eddy currents. The described process flows are easily integrated into middle-of-line (MOL) process flows.

Turning now to a detailed description of aspects of the present invention, FIGS. 1-7B illustrate exemplary methods of making inductor devices according to one or more embodiments. FIG. 1 is a cross-sectional side view of an insulating layer 102 arranged on a substrate 101.

The substrate 101 includes one or more semiconductor materials. Non-limiting examples of suitable substrate 101 materials include Si (silicon), strained Si, SiC (silicon carbide), Ge (germanium), SiGe (silicon germanium), SiGeC (silicon-germanium-carbon), Si alloys, Ge alloys, III-V materials (e.g., GaAs (gallium arsenide), InAs (indium arsenide), InP (indium phosphide), or aluminum arsenide (AlAs)), II-VI materials (e.g., CdSe (cadmium selenide), CdS (cadmium sulfide), CdTe (cadmium telluride), ZnO (zinc oxide), ZnSe (zinc selenide), ZnS (zinc sulfide), or ZnTe (zinc telluride)), or any combination thereof. In one or more embodiments, the substrate 101 includes active areas and isolation regions.

A thin insulating layer 102 is formed on the substrate 101. The insulating layer 102 can include an oxide. Non-limiting examples of oxides include silicon dioxide, tetraethylorthosilicate (TEOS) oxide, high aspect ratio plasma (HARP) oxide, high temperature oxide (HTO), high density plasma (HDP) oxide, oxides (e.g., silicon oxides) formed by an atomic layer deposition (ALD) process, or any combination thereof.

Figures 2A, 2B:
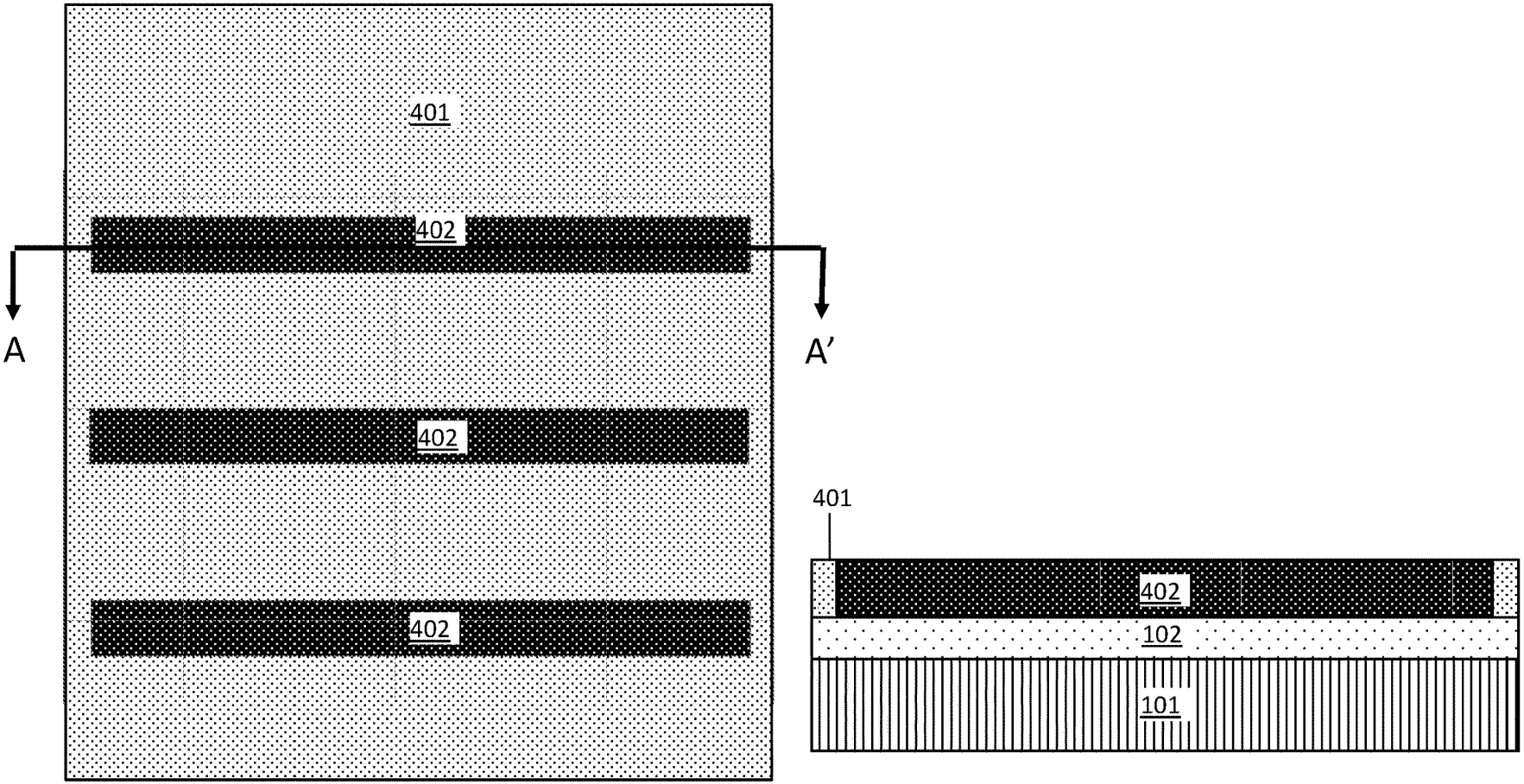
FIG. 2A is a top view after depositing an interlevel dielectric (ILD) layer and forming a first metal layer.
FIG. 2B is a cross-sectional side view through the A-A' axis of FIG. 2A.

FIG. 2A is a top view after depositing an interlayer dielectric (ILD) 401 and forming a first metal layer 402 on the substrate 101. FIG. 2B is a cross-sectional side view through the A-A' axis of FIG. 2A. The ILD 401 can be formed from, for example, a low-k dielectric material (for example, with a k<4.0), including but not limited to, silicon oxide, spin-on-glass, a flowable oxide, a high density plasma oxide, borophosphosilicate glass (BPSG), or any combination thereof. In some embodiments, the ILD 401 can include a dielectric material containing SiN or H-rich SiN. In other embodiments, the ILD 401 can be composed of a low-k dielectric material that can include, but is not limited to, nitrides and/or silicates. Some examples of suitable low-k dielectric materials that can be used to form the ILD 401 include, but are not limited to: $Si_3N_4$, $SiO_2$, Si(O, N), and Si(O, N, II). It is understood, however that other materials having an ultra low-k dielectric constant can be employed. The ILD 401 can also include multiple layers of dielectric material in any combination known in the art. The ILD 401 can be deposited by a deposition process, including, but not limited to chemical vapor deposition (CVD), physical vapor deposition (PVD), plasma enhanced CVD, atomic layer deposition (ALD), evaporation, chemical solution deposition, or other like processes.

Trenches are patterned in the ILD 401 and a first metal is deposited in the trenches to form first metal layers 402. A mask and/or resist, such as a photoresist, is deposited on the ILD 401 and patterned. An etch process, such as a reactive ion etch (ME), is performed using the patterned resist as an etch mask to remove the ILD 401 until the insulating layer 102 is exposed.

The trenches are then filled with a first metal to form first metal layer 402. The first metal layers 402 are arranged substantially parallel to the substrate 101. The first metal can be, but is not limited to, copper (Cu), aluminum (Al), platinum (Pt), gold (Au), tungsten (W), titanium (Ti), or any combination thereof. The first metal is deposited by a suitable deposition process, for example, CVD, PECVD, PVD, electroplating, electroless plating, thermal or e-beam evaporation, or sputtering. A planarization process, for example, chemical mechanical planarization (CMP), is performed to remove the overfilled portion of the first metal from the surface of the ILD 401. The first metal layer 402 can further include a dopant, such as, for example, magnesium, copper, aluminum, or other known dopants. In some embodiments, various of liners (now shown) can be formed in the trench between first metal layer 402 and ILD 401. In some embodiments, a layer of liner material that can serve as a barrier to prevent a metal material from diffusing there through can first be deposited on the walls of the trench (not shown) to form a liner layer (not shown) before filling the trench (not shown) with the metal material. Examples of materials suitable for use as the liner layer (not shown) include, but are not limited to a refractory metal, such as Ti, Ta, W, Ru, a Co, or nitrides thereof (e.g., TiN, TaN, WN, RuN, and CoN). After deposition of the metal first layer 402, a planarization process, such as chemical planarization process (CMP) can be applied to polish the surface down to co-planar with insulating layer 102.

One or more first metal layers 402 (and trenches) are formed in the ILD 401. Although three first metal layers are shown, any number of first metal layers 402 can be formed. In embodiments, a plurality of first metal layers 402 is formed in the ILD 401. The first metal layers 402 are formed in elongated trenches that are substantially parallel to one another within the ILD 401.

Figure 3B:
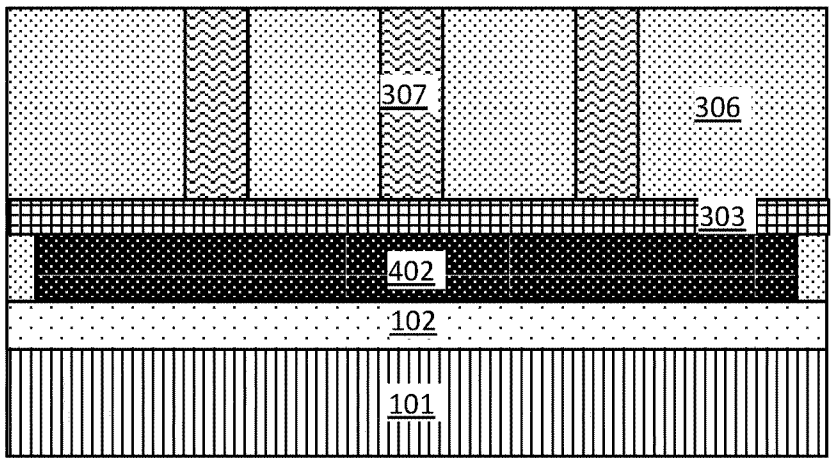
FIG. 3B is a cross-sectional side view through the A-A' axis of FIG. 3A.
Figure 3A:
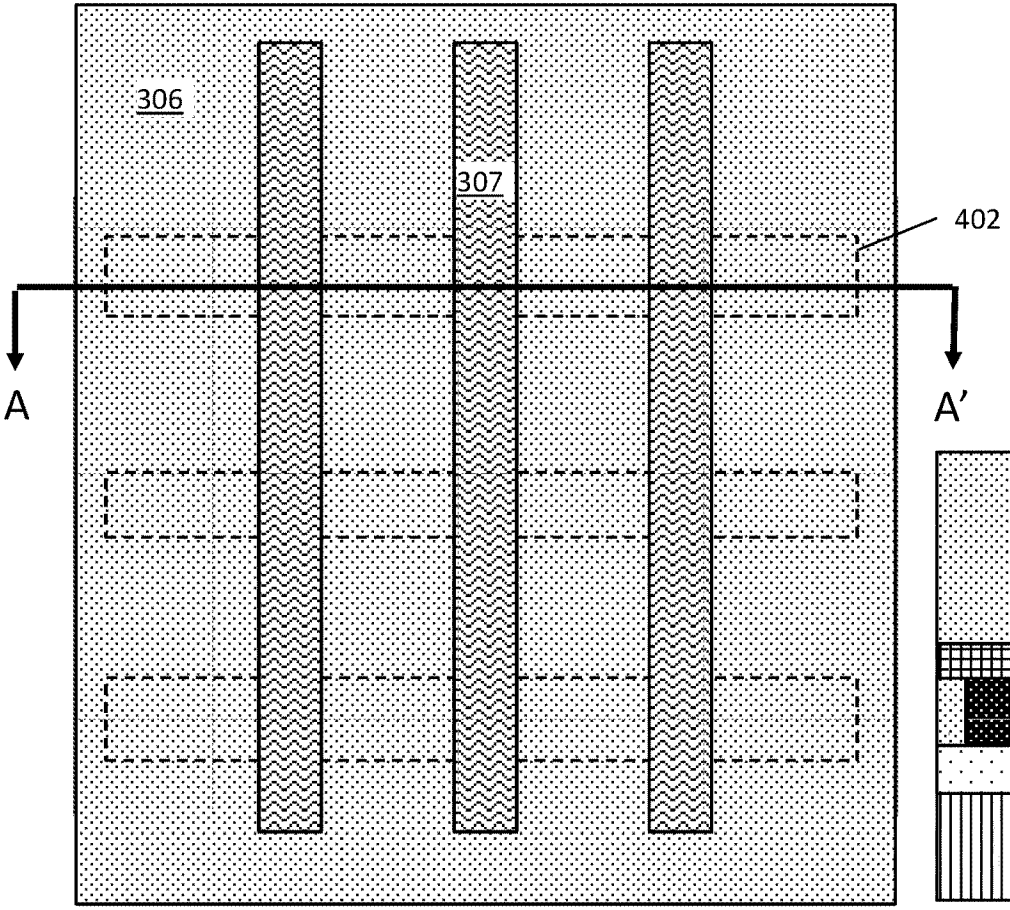
FIG. 3A is a top view after depositing a cap layer and another ILD layer, and patterning and filling trenches with a metal.

FIG. 3A is a top view after depositing a cap layer 303 and another ILD 306 layer on the first metal layers 402, and patterning and filling trenches with a metal 307. FIG. 3B is a cross-sectional side view through the A-A' axis of FIG. 3A.

The cap layer 303 is deposited on the first metal layer 402 before depositing the ILD 306. The cap layer 303 is a dielectric material or an insulating material. The cap layer 303 also acts as an etch stop layer during the trench patterning process aforementioned. In one or more embodiments, the cap layer 303 includes silicon nitride. Other non-limiting examples of materials for the cap layer 303 include dielectric oxides (e.g., silicon oxide), dielectric nitrides, dielectric oxynitrides, or any combination thereof. The dielectric material is deposited by a deposition process, for example, chemical vapor deposition (CVD) or physical vapor deposition (PVD).

After forming the cap layer 303 on the first metal layer 402, the ILD 306 is deposited. The ILD 306 can be the same or different than the ILD 401 surrounding the first metal layers 402 (see FIGS. 2A and 2B). The ILD 306 can be formed from, for example, a low-k dielectric material (for example, with a k<4.0), including but not limited to, silicon oxide, spin-on-glass, a flowable oxide, a high density plasma oxide, borophosphosilicate glass (BPSG), or any combination thereof. The ILD 306 can be deposited by a deposition process, including, but not limited to chemical vapor deposition (CVD), physical vapor deposition (PVD), plasma enhanced CVD, atomic layer deposition (ALD), evaporation, chemical solution deposition, or other like processes.

Trenches are patterned in the ILD 306 and the metal 307 is deposited in the trenches. The trenches are arranged substantially perpendicular to the first metal layers 402, as shown in FIG. 3A. The first metal layers 402 are arranged beneath the trenches filled with the metal 307. A mask and/or resist, such as a photoresist, is deposited on the ILD 306 and patterned. An etch process, such as a reactive ion etch (RIE), is performed using the patterned resist as an etch mask to remove the ILD 306 until the cap layer 303 is exposed.

The trenches are then filled with a magnetic material 307. The magnetic material 307 filled trenches form the magnetic core of the inductor device. In one or more embodiments, the magnetic metal 307 is cobalt. Other non-limiting examples of magnetic materials 307 include nickel, iron, zirconium, tantalum, niobium, rhenium, neodymium, praseodymium, or dysprosium, or combination of these elements, such as alloys. The metal 307 is deposited by a suitable deposition process, for example, CVD, PECVD, PVD, plating, thermal or e-beam evaporation, or sputtering. A planarization process, for example, CMP is performed to remove metal 307 from the surface of the ILD 306.

One or more trenches filled with metal 307 are formed. Although three are shown, any number can be formed. In embodiments, a plurality of trenches filled with metal 307 is formed. The trenches filled with metal 307 can be formed in high density. The trenches filled with metal 307 are laminated within ILD 306.

In some embodiments, a liner layer is deposited in the trenches before depositing the metal 307. The liner layer can include, for example, titanium, titanium nitride, tantalum, tantalum nitride, tungsten, niobium, cobalt titanium, nickel, platinum, or any combination thereof.

Figure 4B:
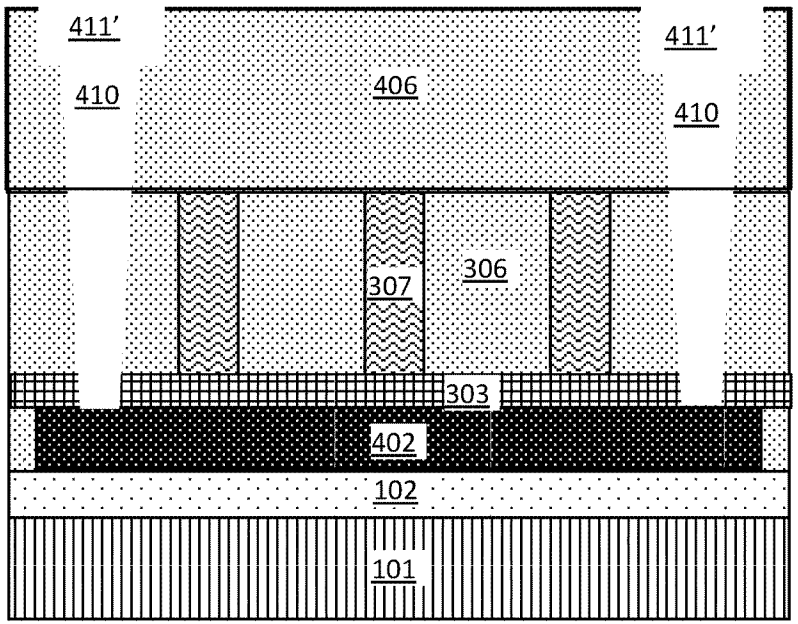
FIG. 4B is a cross-sectional side view through the A-A' axis of FIG. 4A.
Figure 4A:
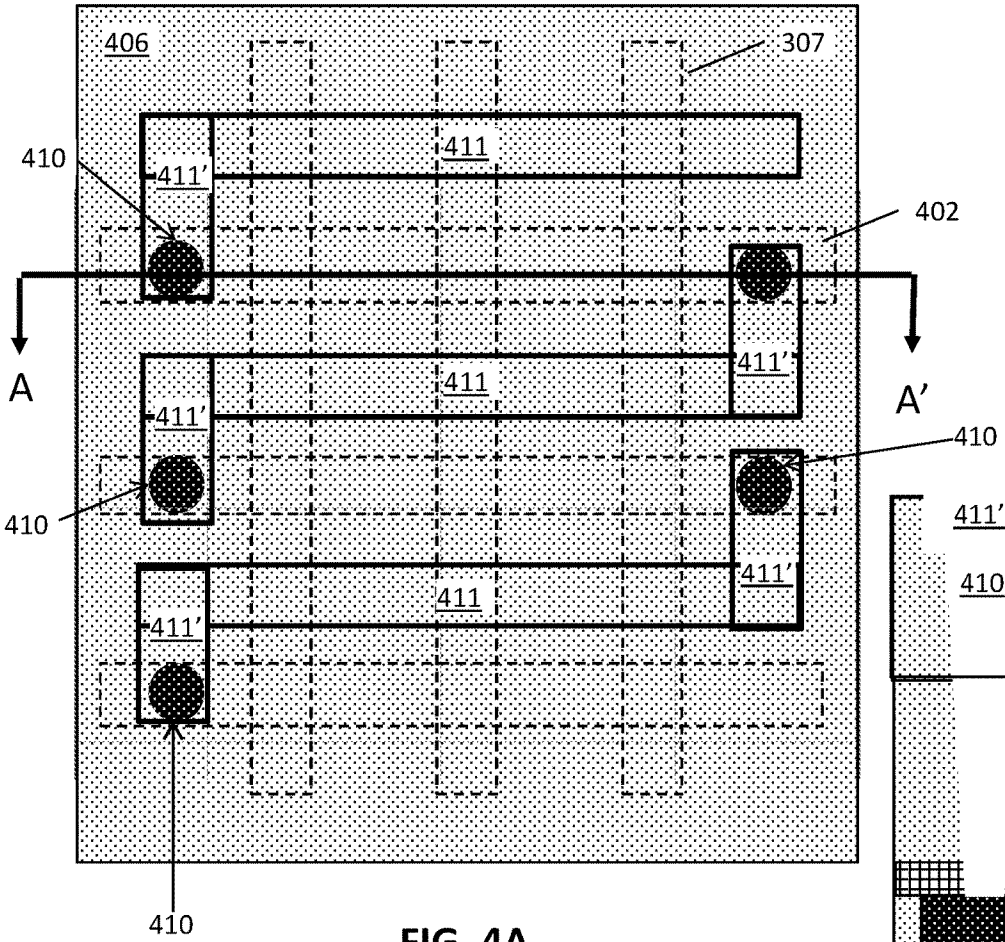
FIG. 4A is a top view after depositing an ILD layer and patterning trenches and vias for a second metal layer.

FIG. 4A is a top view after depositing another ILD 406 layer on the metal 307 filled trenches, and then patterning trenches 411, 411' and vias 410 for a second metal layer. FIG. 4B is a cross-sectional side view through the A-A' axis of FIG. 4A. Trenches 411, 411' and vias 410 form interconnect openings.

The ILD 406 can be the same or different than the ILD 306 surrounding the metal 307. Now the magnetic core of the metal 307 filled trenches are further laminated within ILD 406. The ILD 406 can be formed from, for example, a low-k dielectric material (for example, with a k<4.0), including but not limited to, silicon oxide, spin-on-glass, a flowable oxide, a high density plasma oxide, borophosphosilicate glass (BPSG), or any combination thereof. The ILD 307 can be deposited by a deposition process, including, but not limited to chemical vapor deposition (CVD), physical vapor deposition (PVD), plasma enhanced CVD, atomic layer deposition (ALD), evaporation, chemical solution deposition, or other like processes.

Vias 410 are etched through the ILD 406, ILD 306, and cap layer 303. The vias 410 from a top surface of the ILD 406 to the level of the first metal layers 402. The vias 410 are formed adjacent to and outside the series of parallel metal 307 filled trenches (forming the laminated magnetic core), and are arranged substantially parallel to the metal 307 filled trenches, as well as substantially perpendicular to the first metal layers 402. Vias 410 are thus arranged on adjacent ends of the series of metal 307 filled trenches such that the vias 410 flank the series of metal 307 filled trenches arranged in parallel. Although arranged parallel to the metal filled 307 trenches, the vias extend over the metal 307 filled trenches and through the ILD 406 to connect to trenches 411, 411'. The vias 410 extend above and below the trenches filled with metal 307 that form the magnetic core.

The vias 410 are formed by patterning and one or more etching processes to remove the ILD 406, ILD 306, and cap layer 303. Any number of vias 410 is formed. In embodiments, a plurality of vias 410 is formed.

The trenches 411, 411' will be filled with a second metal to form second metal layers (see FIGS. 5A-6B). Two sets (portions) of trenches are formed, 411 (first portions) and 411' (second portions). Trenches 411 run over and substantially parallel to the first metal layers 402. Trenches 411 also interdigitate the first metal layer 402, as shown in FIG. 4A, such that the trenches 411 are arranged over and adjacent to the first metal layers 402. Trenches 411' are formed substantially perpendicular to trenches 411 (and substantially parallel to metal 307 filled trenches 307) to connect trenches 411 to vias 410. Trenches 411' extend from opposing ends of the trenches 411 and are oriented in opposite directions such that the trenches 411' extend over both adjacent first metal layers 402. The trenches 411' are continuous with the vias 410. The trenches 411, 411' are formed by patterning and one or more etching processes to remove portions of the ILD 406.

The interconnect openings (vias 410 and trenches 411, 411') can be formed by, for example, conventional damascene processing (i.e., pattering a hardmask (not shown) through a photolithography process and then etching the ILD 406 and ILD 306 using an etching process that can include one or more steps). In one or more embodiments, the via 410 and trenches 411, 411' can be formed using a conventional dual damascene process, such as for example, trench first dual damascene. The etching process can include a dry etching process such as reactive ion etching (ME), ion beam etching, or plasma etching. It should be noted that during the etching processes used to form the trenches 411, 411' and via 410, the bottom cap layer 303 will be removed selectively to the bottom metal layer 402 in order to form a metal connection after the metal deposition.

Figures 5A, 5B:
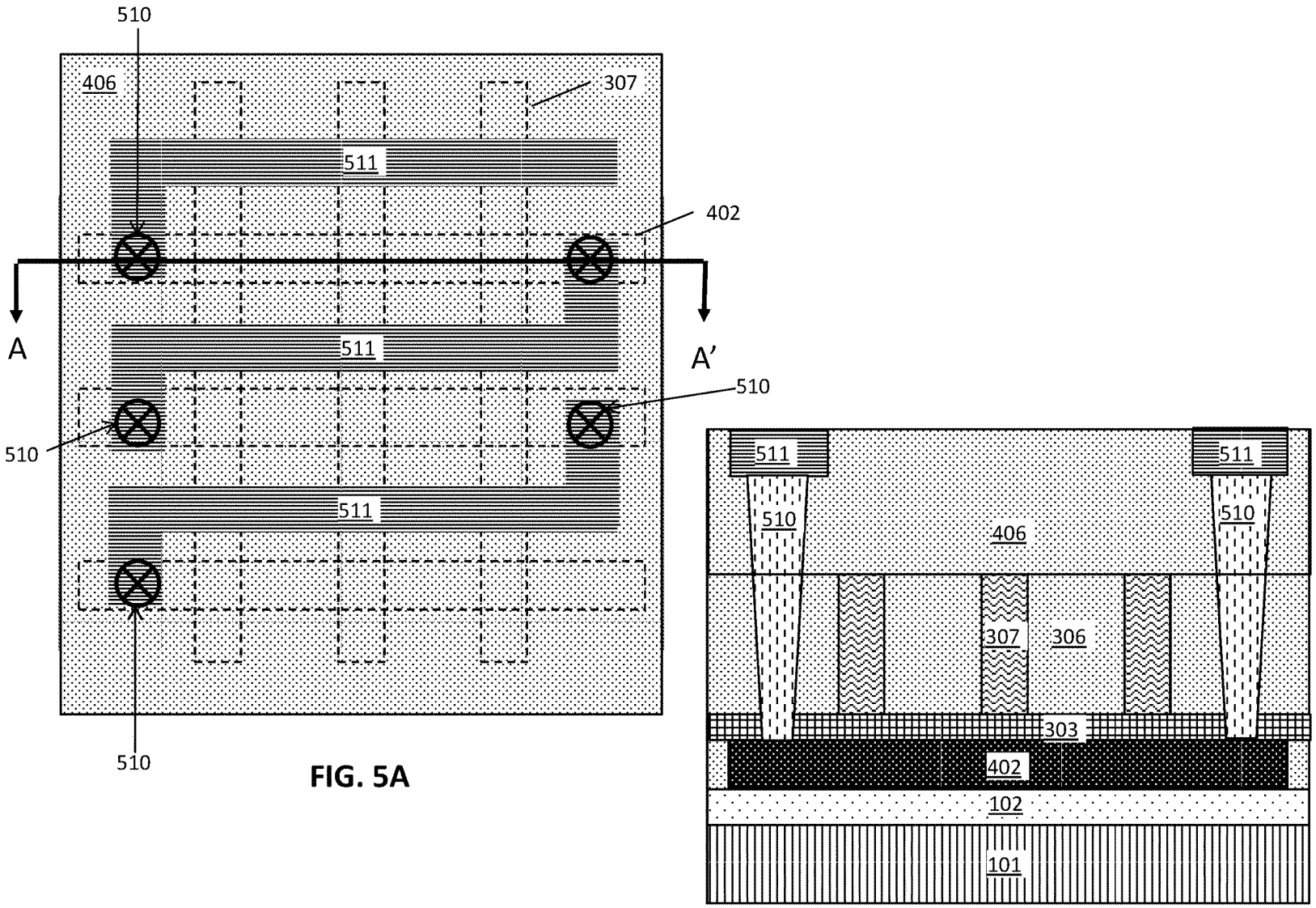
FIG. 5A is a top view after filling the vias and the trenches with a second metal.
FIG. 5B is a cross-sectional side view through the A-A' axis of FIG. 5A.
Figure 6B:
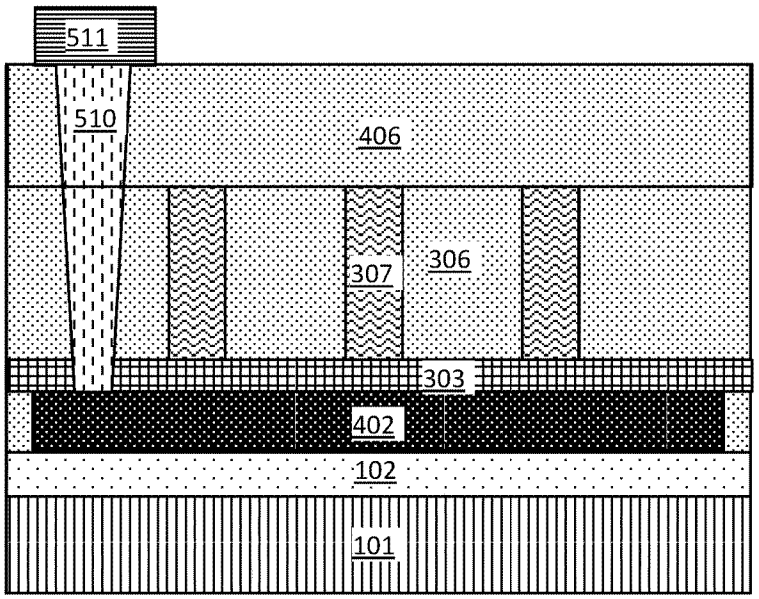
Figure 6A:
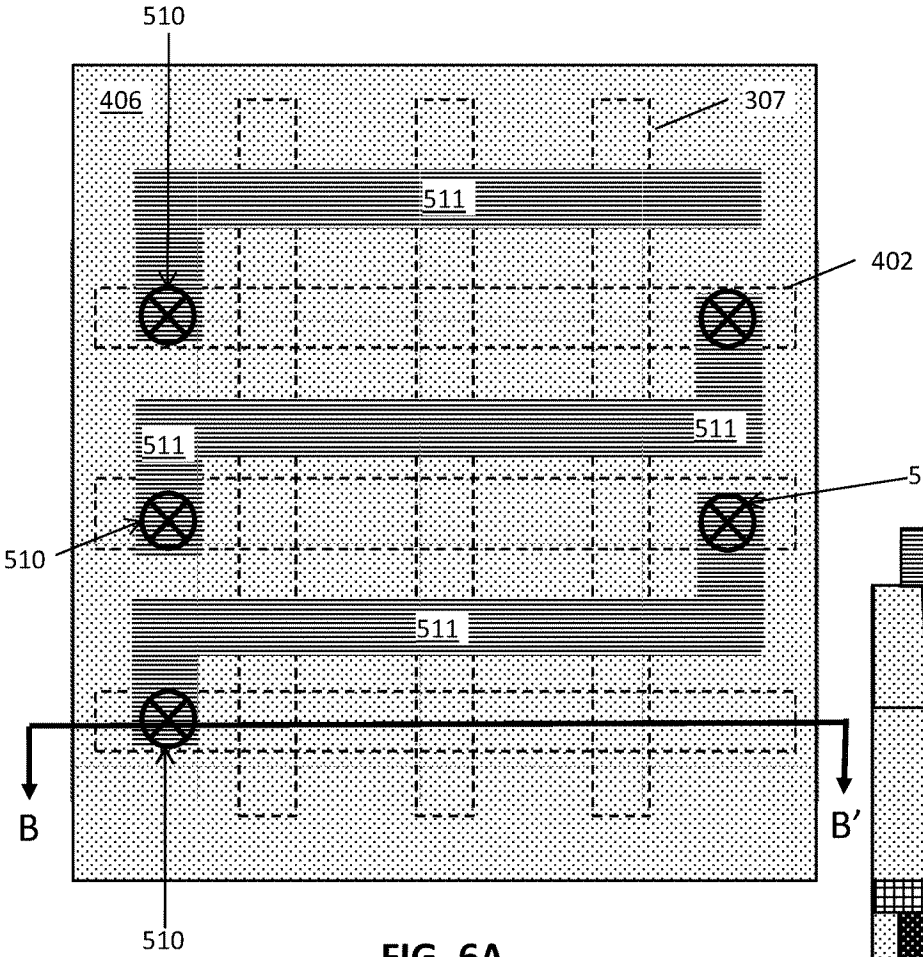
FIG. 6A is a top view (of FIG. 5A) showing a B-B' axis for comparison.

FIG. 5A is a top view after filling the vias and the trenches with a second metal to form second metal layers. FIG. 5B is a cross-sectional side view through the A-A' axis of FIG. 5A. FIG. 6A is a top view (of FIG. 5A) showing a B-B' axis for comparison. FIG. 6B is a cross-sectional side view through the B-B' axis of FIG. 6A.

The metal 510 filling the vias can be the same or different than the metal 511 filling the trenches. The second metal can be, but is not limited to, copper (Cu), aluminum (Al), platinum (Pt), gold (Au), tungsten (W), titanium (Ti), or any combination thereof. The second metal is deposited by a suitable deposition process, for example, CVD, PECVD, PVD, plating, thermal or e-beam evaporation, or sputtering. A planarization process, for example, CMP, performed to remove second metal from the surface of the ILD 406.

The metal 511 filling the trenches form second second metal layers. The second metal layers are arranged over the metal 307 filled core. One or more second metal layers are formed in the ILD 406. Although three second metal layers are shown, any number of second metal layers can be formed. In embodiments, a plurality of second metal layers is formed. In other embodiments, a liner (not shown) composed of one or more layers can be formed in the trenches 411, 411' and 410 (see FIG. 4B) before the metals 510, 511 are deposited. In some embodiments, the liner (not shown) can be composed of a first layer containing tantalum nitride (TaN) and a second layer containing tantalum (Ta). In another embodiment, the liner (not shown) can be composed of a first layer containing titanium nitride (TiN) and a second layer containing titanium (Ti). In yet other embodiments, the liner (not shown) can be composed of a first layer containing tungsten nitride (WN) and a second layer containing tungsten (W). In yet other embodiments, the liner (not shown) can be composed of a first layer containing ruthenium nitride (RuN) and a second layer containing ruthenium (Ru).

In one or more embodiments, metals 510, 511 and first metal layer 402 include the same material, for example, copper. In some embodiments, metals 510, 511 can be filled at the same time after the openings have been formed.

As shown the first metal layers are connected to the second metal layers in a spiral structure through the vias. The spiral structure is a continuous metal filled inductor. The spiral inductor structure surrounds the laminated magnetic core of cobalt in one or more embodiments.

Figure 7B:
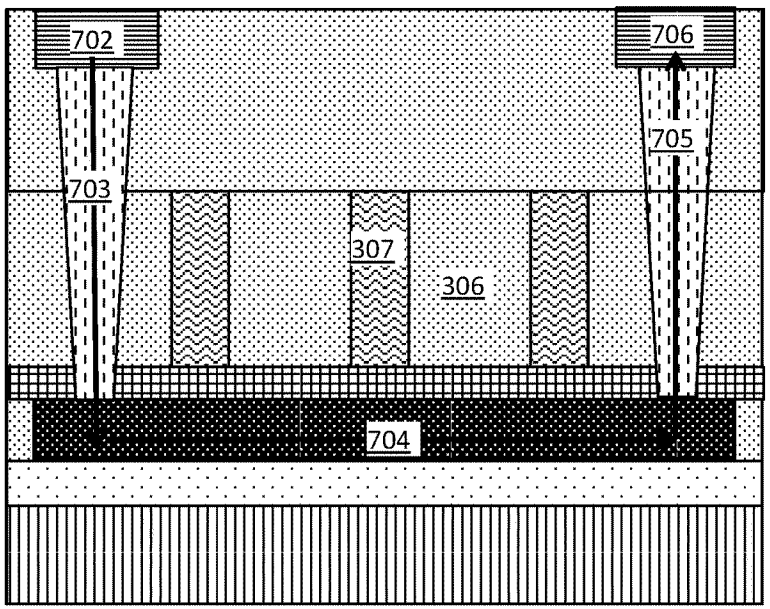
FIG. 7B is a cross-sectional side view of FIG. 7A.
Figure 7A:
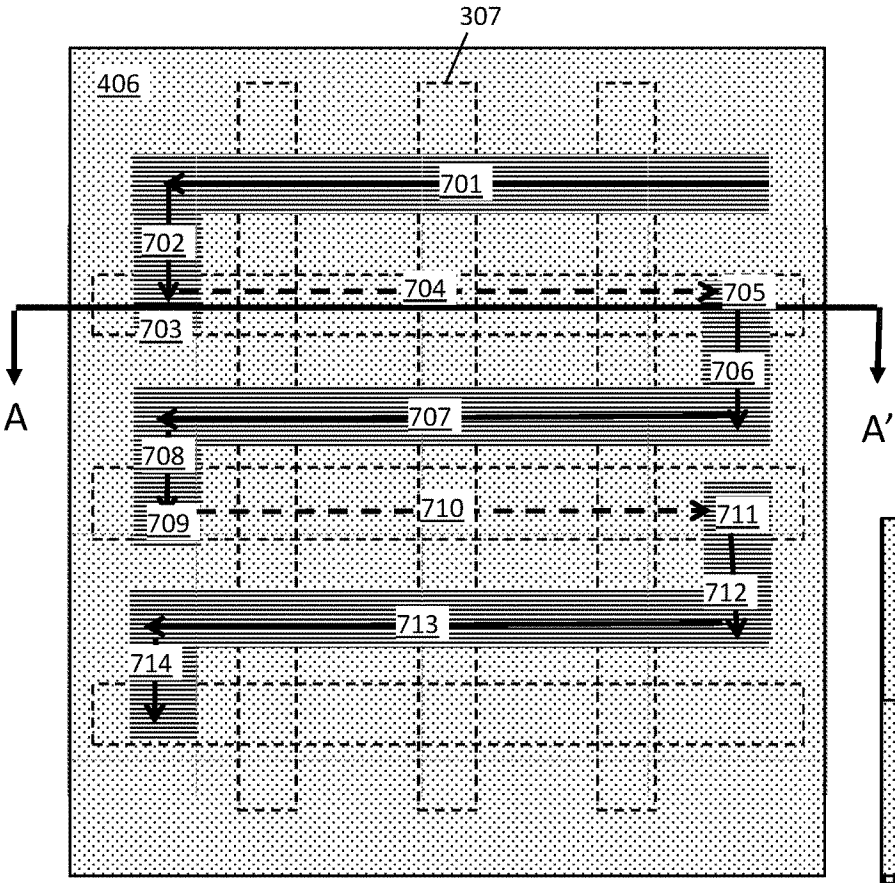
FIG. 7A is a top view of the device showing current flowing through the metal layers.

FIG. 7A is a top view of the inductor device showing current flowing through the metal layers. FIG. 7B is a cross-sectional side view of FIG. 7A. The process flows described above form inductors in which metal 307 filled trenches can be formed in high density and laminated within dielectric (ILD 306). The metal 307 filled trenches, which are cobalt in one or more embodiments, form a laminated magnetic core that provides improved device performance and reduces energy loss during operation.

Current flows through a spiral structure that connects first and second metal layers. Current flows, for example, as shown in FIGS. 7A and 7B. Current travels through the second metal layer trenches 701, 702 and down through via 703 to first metal layer 704. Then current returns through via 705 to second metal layer trenches 706, 707, 708. The current follows via 709 to first metal layer 710 and then again returns through via 711 to second metal layer trenches 712, 713, 714.

The descriptions of the various embodiments of the present invention have been presented for purposes of illustration, but are not intended to be exhaustive or limited to the embodiments described. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments described herein.

What is claimed is:

1. An inductor device, comprising:

a substrate;

a plurality of first trenches comprising a first metal arranged on the substrate, the plurality of first trenches forming first metal layers, the first metal layers being arranged substantially parallel to the substrate;

a plurality of second trenches comprising a second metal arranged over the first metal layers and forming second metal layers, the plurality of second trenches comprising two portions, first portions and second portions, the first portions arranged substantially parallel to and interdigitating the first metal layers, and the second portions arranged substantially perpendicular to the first portions, extending from both ends of the first portions, and oriented in opposite directions such that the second portions extend over ends of adjacent first metal layers;

a plurality of vias connecting the first metal layers to the second metal layers; and a plurality of magnetic trenches arranged on the substrate, the plurality of magnetic trenches being arranged over the first metal layers, under the second metal layers, and substantially parallel to the second portions of the plurality of second trenches.

2. The inductor device of claim 1, wherein the first metal of the first metal layers is copper.

3. The inductor device of claim 1, wherein the first metal of the first metal layers is aluminum.

4. The inductor device of claim 1, wherein the first metal of the first metal layers is platinum, gold, tungsten, titanium, or any combination thereof.

5. The inductor device of claim 1, wherein the second metal of the second metal layers is copper.

6. The inductor device of claim 1, wherein the second metal of the second metal layers is aluminum.

7. The inductor device of claim 1, wherein the second metal of the second metal layers is platinum, gold, tungsten, titanium, or any combination thereof.

8. The inductor device of claim 1, wherein the plurality of vias comprise a same metal as the second metal layers.

9. The inductor device of claim 1, wherein the plurality of vias comprise a different metal than the second metal layers.

10. The inductor device of claim 1, wherein a combination of the first metal layers, the plurality of vias, and the second metal layers form a continuous spiral of metal.

11. The inductor device of claim 1, wherein the plurality of vias comprise a laminated magnetic core of cobalt.

12. The inductor device of claim 1, wherein the plurality of magnetic trenches are arranged within an interlayer dielectric (ILD).

13. The inductor device of claim 1, wherein the substrate further comprises an insulating layer arranged beneath the first metal layers.

14. The inductor device of claim 1, wherein the plurality of magnetic trenches comprise cobalt.

15. The inductor device of claim 1, wherein the plurality of magnetic trenches are nickel, iron, zirconium, tantalum, niobium, rhenium, neodymium, praseodymium, or dysprosium, or combination of these elements, such as alloys.

16. The inductor device of claim 1, wherein the plurality of vias extends above the plurality of trenches.

17. The inductor device of claim 15, wherein the plurality of vias extends below the plurality of trenches.

18. The inductor device of claim 1, wherein the plurality of magnetic trenches comprise a liner and a magnetic material.

19. The inductor device of claim 18, wherein the liner is titanium, titanium nitride, tantalum, tantalum nitride, tungsten, niobium, cobalt titanium, nickel, platinum, or any combination thereof.

20. The inductor device of claim 1, wherein the plurality of first trenches and plurality of second trenches further comprise a liner.

* * * * *